United States Patent [19]

Billon et al.

[11] 4,414,105

[45] Nov. 8, 1983

[54] PROCESS FOR DEASPHALTING AN ASPHALTENE CONTAINING HYDROCARBON CHARGE

[75] Inventors: Alain Billon, Orlienas; Pierre Renard, St Nom la Breteche; Jean-Claude Simandoux, La Graviere; Gérard Heinrich, Saint Germain en Laye, all of France

[73] Assignee: Institut Francais du Petrole, Rueil-Malmaison, France

[21] Appl. No.: 298,431

[22] Filed: Sep. 1, 1981

[30] Foreign Application Priority Data

Sep. 1, 1980 [FR] France ..... 80 18900

[51] Int. Cl.[3] ..... C10C 3/00

[52] U.S. Cl. ..... 208/309; 196/14.52

[58] Field of Search ..... 208/309, 45; 196/14.52

[56] References Cited

U.S. PATENT DOCUMENTS

| | | | |
|---|---|---|---|
| 2,029,688 | 2/1936 | Wilson | 196/13 |
| 2,900,308 | 8/1959 | Matyear, Jr. | 196/14.52 |
| 2,950,244 | 4/1960 | Lawson, Jr. | 208/309 |
| 3,414,506 | 12/1968 | Campagne | 208/309 |
| 3,627,675 | 12/1971 | Ditman | 208/309 |

*Primary Examiner*—G. L. Kaplan
*Assistant Examiner*—William Leader
*Attorney, Agent, or Firm*—Millen & White

[57] ABSTRACT

Process for deasphalting an asphaltene-containing hydrocarbon charge wherein said charge, admixed with a first fraction of light paraffinic hydrocarbon solvent, is passed through an elongate zone inclined by 2° to 15° to a horizontal line while a second fraction of light paraffinic hydrocarbon solvent is introduced at one or more points of the lower half of said elongate zone, downwardly in an angle from 10° to 80° with the main axis thereof oriented in the direction of flow of the mixture, and wherein the upper phase of deasphalted oil and the lower asphalt phase are separately withdrawn, the light hydrocarbon being separated from each of these phases.

8 Claims, 1 Drawing Figure

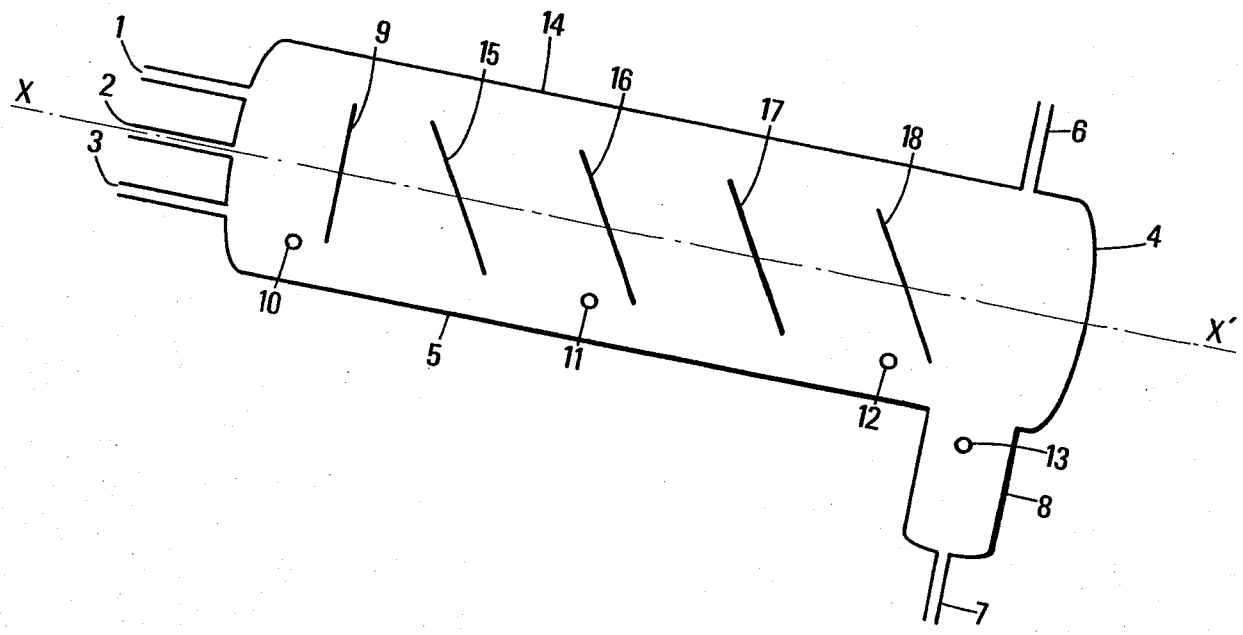
X
X'
1
2
3
4
5
6
7
8
9
10
11
12
13
14
15
16
17
18

PROCESS FOR DEASPHALTING AN ASPHALTENE CONTAINING HYDROCARBON CHARGE

The present invention concerns the separation of asphaltenes (or asphalts) contained in a hydrocarbon oil by making use of a solvent selected from liquid paraffinic hydrocarbons, preferably those having from 4 to 7 carbon atoms.

Representative charges to be deasphalted are residual oils from crude oil distillation, residues obtained from oily sands or bituminous shales, or stripped crude oils. Examples are Boscan crude oil or a heavy crude oil from the Orenoque belt or from Athabasca.

By solvent deasphalting it is possible to separate the asphaltenic oil into an asphalt fraction and an oil free from at least a portion of the asphalts.

Deasphalting has been effected up to now in apparatuses of various shapes and structures, for example simple containers which may contain baffles or columns, for example columns with stationary or rotating discs.

This operation is effected in a relatively simple manner when the solvent is light, particularly when using propane, since the asphalt is obtained in a relatively fluid state, with however the disadvantage of a poor yield of deasphalted oil.

The use of paraffinic hydrocarbons having from 4 to 7 carbon atoms provides for a better yield of oil, but the asphalt is much more viscous and the separation between the oily phase and the asphalt phase becomes difficult.

The invention describes a new technique which provides for an easy separation of the asphalt fraction, even when using a $C_4$ to $C_7$ hydrocarbon as solvent.

The invention will be better understood from the following description, given with reference to the accompanying drawing.

FIG. 1 is a schematic illustration of a preferred apparatus used in conducting the process of the invention.

Through one or several ducts such as 1, 2 and 3, there is introduced at about 150°–220° C., a previously effected mixture of asphaltenic oil with a hydrocarbon solvent into an elongated enclosure 4 substantially horizontal but at least the base 5 of which has a slight slope in the direction of flow of the liquids. This slope corresponds, for example, to an inclination by an angle from 2° to 15° to a horizontal line.

By substantially horizontal enclosure, is meant an enclosure whose main axis is oriented along a direction at a small or zero angle to a horizontal line, for example an angle from 0° to 15°, preferably in a downward direction.

During its passage through the apparatus, used as settler, the mixture is separated into an upper oily phase, which is discharged through the upper duct 6, and a lower asphaltenic phase, which is discharged through the lower duct 7 from a well 8 provided at the bottom of the enclosure 4. This well is however not indispensable. The well 8 and the duct 6 are arranged at locations relatively close to the end part of the enclosure 4 opposite to the feeding point. One or more plates, perforated or not, such as 9, are usefully provided in a direction either vertical or substantially perpendicular to the direction of the larger size of the enclosure, in order to favour the formation of an interface between the two phases. The enclosure 4 will advantageously have a substantially cylindrical section; in this case the upper part 14 will be parallel to the base 5, but this is not indispensable. The section may also be square, rectangular or of another shape.

The main difficulty to overcome is that of obtaining a satisfactoy flowing of the asphaltic phase to the bottom of the apparatus. This is achieved according to the invention by introducing a paraffinic hydrocarbon solvent in the $C_4$ to $C_7$ range, and preferably $C_5$, at one or more points such as 10, 11, 12 located in the lower half of the enclosure; this solvent, which will be hereinafter called "auxiliary solvent", is preferably injected downwardly along an average direction forming an angle from 10° to 80°, preferably from 30° to 60°, with the main axis XX′ of the enclosure, that is, the central axis in the elongated direction joining the inlet end portion to the outlet end portion. For this purpose the elements 10, 11 and 12 are advantageously spray tubes arranged perpendicularly to the plane of the FIGURE and provided with perforations at their lower part through which said injection is effected.

The auxiliary solvent is injected at a temperature at least 20° C. lower than the injection temperature of the charge, for example 20° to 100° C. and preferably 40° to 75° C. below said temperature. The auxiliary solvent will be accordingly in most cases introduced at a temperature ranging from 80° to 150° C.

Preferably, a complementary injection of auxiliary solvent is provided in the well 8. This injection is effected from a spray tube 13 similar to the spray tubes 10 to 12 and in the same range of temperatures as the injections through the spray tubes 10 to 12; however, it is preferred to adjust the temperature at a level at least 10° C. lower than that of the latter injections.

It is essential that the auxiliary solvent be introduced at a lower temperature than that of introduction of the mixture supplied through lines 1, 2 and 3. This makes it possible to dilute the precipitated asphalt, which result would not be achieved or would be achieved only to an insufficient extent in the opposite case.

According to a preferred embodiment, there is arranged inside the enclosure a plurality of baffles such as 15 to 18, whose shape and sizes may be very variable and which, as a whole, are so oriented as to form, downwardy, an angle from 15° to 75°, preferably from 30° to 50° with the axis XX′ oriented in the direction from X to X′.

The amount of hydrocarbon solvent (main deasphalting solvent) introduced in admixture with the asphaltenic oil is usually such that the ratio by volume of the solvent to the asphaltenic oil subjected to the deasphalting operation be from 1:1 to 10:1, preferably from 2:1 to 6:1.

The amount of auxiliary hydrocarbon solvent is usually such that the ratio by volume of the auxiliary solvent to the asphaltenic oil subjected to the deasphalting operation be from 0.2:1 to 3:1, preferably from 0.4:1 to 2:1.

The mode of admixture of the main solvent to the asphaltenic charge of hydrocarbons is not critical and may result, for example, from the passage through an apparatus comprising stirring means, for example a turbine mixer or an "on-line" mixer. Similarly, the mode of subsequently separating the solvent driven along with the oily phase and the asphalt phase is not critical, the invention being not concerned with these peculiarities. The recovered solvent is advantageously reused as main solvent and/or auxiliary solvent.

By way of example, a cylindrical enclosure has been used and a deasphalting operation has been effected on a vacuum residue whose composition is given in table I. The main deasphalting solvent, admixed "on-line" with the oil, was a pentane cut used in a ratio by volume of the pentane cut to the vacuum residue of 4:1. The resultant mixture was introduced at 175° C. into the settler (4) whose axis XX' was inclined by an angle of 5° below a horizontal line. Through lines (10, 11 and 12) the pentane cut was introduced at a temperature of 120° C., downwardly, in a direction at an angle of 45° C. with axis XX'. The ratio by volume of this auxiliary pentane to the vacuum residue was 1:1. At mid-height of the well (8), n-pentane was injected, downwardly, at a temperature of 90° C. (ratio by volume of pentane to the vacuum residue: 0.5:1). Four baffles (15 to 18), inclined at 40° C. below a horizontal line, and a baffle (9) perpendicular to the axis XX' were provided. The surface of the baffles was about 40% of the section of the cylindrical enclosure (4).

This apparatus made it possible to obtain an efficient deasphalting, as indicated in Table I. The treatment capacity attained 1 $m^3$ of hydrocarbon charge/$m^3$ of enclosure/hour. The yield of deasphalted oil was 82% by weight.

TABLE I

| | Vacuum residue | Deasphalted oil |
|---|---|---|
| Specific weight (g/cm$^3$) | 1.002 | 0.976 |
| Conradson carbon (% by weight) | 16.2 | 9.0 |
| Asphaltenes (insoluble in heptane, % by weight) | 4.0 | 0.05 |
| Viscosity at 100° C. (m$^2$/s) | $3.65 \cdot 10^{-4}$ | $1.1 \cdot 10^{-4}$ |
| Ni (ppm by weight) | 20 | 7 |
| V (ppm by weight) | 55 | 14 |

Although the invention was described with the use, as deasphalting solvent, of at least one hydrocarbon having from 4 to 7 carbon atoms, this being the most interesting case, it is clear that the device may be used with lighter hydrocarbons of the $C_3$ type.

What is claimed is:

1. A process for deasphalting an asphaltene containing hydrocarbon charge, characterized by the steps of:

(a) Introducing a mixture of the hydrocarbon charge with at least a first fraction of light paraffinic hydrocarbon solvent at a first end portion of a substantially horizontal elongated zone whose base slopes downwardly in the elongated direction from the first end portion to a second end portion opposite the first end portion at an angle from 2° to 15° to a horizontal line, (b) Flowing said mixture from the first end portion to the second end portion of the elongated zone, (c) Introducing into said elongated zone at least one second fraction of light paraffinic hydrocarbon solvent at a temperature at least 20° C. lower than the temperature of introduction of said mixture, said introduction being effected at one or more points located in the lower half of the elongated zone, in a downward direction forming an average angle of 10° to 80° with the central axis in the elongated direction of said elongated zone, oriented in the direction of flow of the mixture, and (d) separately withdrawing an upper phase of deasphalted oil and a lower asphalt phase and separating the light hydrocarbon from each of these phases.

2. A process according to claim 1, wherein the direction of introduction of the second light hydrocarbon fraction forms an average angle of 30° to 60° with the main axis of the enclosure.

3. A process according to claim 1, wherein the mixture is introduced at 150°-220° C. and the second light hydrocarbon fraction at 80°-150° C.

4. A process according to claim 1, wherein the temperature of introduction of the second light hydrocarbon fraction is 40° to 75° C. lower than the temperature of introduction of the mixture.

5. A process according to claim 1, wherein a complementary injection of light hydrocarbon is effected in the vicinity of the point of withdrawal of the asphalt lower phase.

6. A process according to claim 5, wherein the complementary injection is effected at a temperature at least 10° lower than that of introduction of the second hydrocarbon fraction.

7. A process according to claim 1, wherein the stream of mixture to be separated meets with at least one surface arranged in an inclined manner in the elongated zone, forming downwardly an angle from 15° to 75° with the central axis of the elongate zone oriented in the direction of flow of the mixture.

8. A process according to claim 1, wherein the ratio by volume of the first light paraffinic hydrocarbon fraction to the hydrocarbon charge is from 1:1 to 10:1 and the ratio of the second light paraffinic hydrocarbon fraction to the hydrocarbon charge is from 0.2:1 to 3:1.

* * * * *